US005358083A

United States Patent [19]

Ku

[11] Patent Number: 5,358,083

[45] Date of Patent: Oct. 25, 1994

[54] TRUNK CASE

[76] Inventor: Molton Ku, No. 9, Alley 15, Lane 77, San-Hsing St., Ta-Li Hsiang, Taichung Hsien, Taiwan

[21] Appl. No.: 153,634

[22] Filed: Nov. 17, 1993

[51] Int. Cl.[5] ..... A45C 13/04

[52] U.S. Cl. ..... 190/123; 150/125; 150/126

[58] Field of Search ..... 190/122, 123; 150/124, 150/125, 126

[56] References Cited

U.S. PATENT DOCUMENTS

| | | | |
|---|---|---|---|
| 1,430,768 | 10/1922 | Tannenbaum | 190/123 |
| 1,690,507 | 11/1928 | Shwayder | 190/123 |
| 2,393,487 | 1/1946 | Storch | 150/124 |
| 2,537,504 | 1/1951 | Anderson | 150/125 X |
| 2,858,869 | 11/1958 | Solomon | 150/126 X |
| 3,077,912 | 2/1963 | Kiehl | 150/125 |
| 3,093,176 | 6/1963 | Kahn | 150/125 |
| 3,097,678 | 7/1963 | Paynor | 150/126 |
| 3,234,985 | 2/1966 | Gilbert | 150/125 X |
| 3,557,845 | 1/1971 | Reitzel | 150/125 |
| 4,762,211 | 8/1988 | Krenzel | 190/122 |
| 4,823,924 | 4/1989 | Goodin | 190/123 X |

FOREIGN PATENT DOCUMENTS

| | | | |
|---|---|---|---|
| 480438 | 2/1938 | United Kingdom | 150/126 |
| 1415972 | 12/1975 | United Kingdom | 190/123 |

*Primary Examiner*—Allan N. Shoap
*Assistant Examiner*—Christopher J. McDonald
*Attorney, Agent, or Firm*—Ladas & Parry

[57] ABSTRACT

A trunk case includes first and second casings which are hinged together at one side and a frame member which is mounted to the peripheral edge of the respective casing. The peripheral edge of each of the casings has an enlarged portion. The frame member includes an engaging portion with a groove that is defined by two opposed plates and a pair of ribs that project respectively from inner surfaces of the opposed plates. The enlarged portion of the respective casing extend into a bottom of the groove and engages securely the ribs adjacent to the enlarged portion thereof.

4 Claims, 5 Drawing Sheets

TRUNK CASE

BACKGROUND OF THE INVENTION

1. FIELD OF THE INVENTION

The invention relates to a trunk case, more particularly to trunk case with a frame member which is provided around the peripheral edge of the trunk case.

2. DESCRIPTION OF THE RELATED ART

FIG. 1 shows a partially enlarged view of a conventional trunk case which includes a first and second casings 10, 20 that are hinged pivotally at one side thereof. Each of the first and second casings 10, 20 has a substantially flat bottom 12, 22 and a surrounding wall 11, 21 formed around the periphery of the bottom 12, 22 to define the respective casing 10, 20. Each of the casings 10, 20 has a connecting frame 40, 30 which respectively includes a vertical portion 42, 32, a horizontal portion 41, 31 which cooperates with the vertical portion 42, 32 to define a groove 43, 33 therebetween to permit the peripheral edge 21, 11 of the surrounding wall 11, 12 to extend thereinto so as to engage the same. The connecting frames 40, 30 are compressed in such a manner that the vertical and horizontal portions of the connecting frames 40, 30 cooperate to clamp the peripheral edge 21, 11 of the respective casing 10, 20, thereby fastening the connecting frames 30, 40 to the respective casing 10, 20.

As best illustrated, the connecting frame 40 that is mounted along the peripheral edge 21 of the second casing 20 includes an elongated groove 44 formed at the lowermost section of the horizontal portion 41. The connecting frame 30 that is mounted along the peripheral edge 11 of the first casing 10 further includes an elongated groove 34 which is formed along the peripheral edge of the horizontal portion 31, and a vertical connecting plate 35 which has an elongated protrusion 352 that is formed thereon along and adjacent to a lowermost section thereof and that is received engageably in the elongated groove 34 of the connecting frame 30. The vertical connecting plate 35 has a peripheral edge 351 which is tapered so that it fits into the elongated groove 44 of the connecting frame 40 when the first and second casings 10, 20 are at a closed position.

A main drawback of the conventional trunk case is that the peripheral edges of the casing 10, 20 disengage from the connecting frames 40, 30 after a period of use, thereby rendering the conventional trunk case useless. This is due to the fact that the peripheral edges of the casings 10, 20 and the connecting frames 40, 30 are not capable of holding one another securely.

SUMMARY OF THE INVENTION

The main objective of the present invention is to provide a trunk case which has includes peripheral edges that can engage securely connecting members of the same.

Accordingly, the trunk case of the present invention is substantially similar to the conventional trunk case except that the surrounding wall of the respective casing has an enlarged portion formed along its peripheral edge, and that the frame member has an engaging portion which is formed with a groove that is defined by two opposed plates and a pair of ribs that project respectively from inner surfaces of the opposed plates in a staggered manner with the enlarged portion extending into a bottom of the groove. The surrounding wall is clamped by the ribs near the enlarged portion of the same.

In the preferred embodiment, the respective casing is made of a sheet of cloth and the surrounding wall has a folded portion formed along the peripheral edge thereof. The folded portion has an insert layer which is made of plastic and which is sandwiched fixedly in the folded portion. A rigid bar is embedded in the periphery of the folded portion, thereby forming the enlarged portion.

The connecting frame employed in the preferred embodiment is made of aluminum so that the opposed plates of the same can be pressed towards one another in order to permit the ribs to engage securely the enlarged portion of the surrounding wall. Thus, the connecting frame cannot disengage from the respective casing.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENTS

Figure 1:
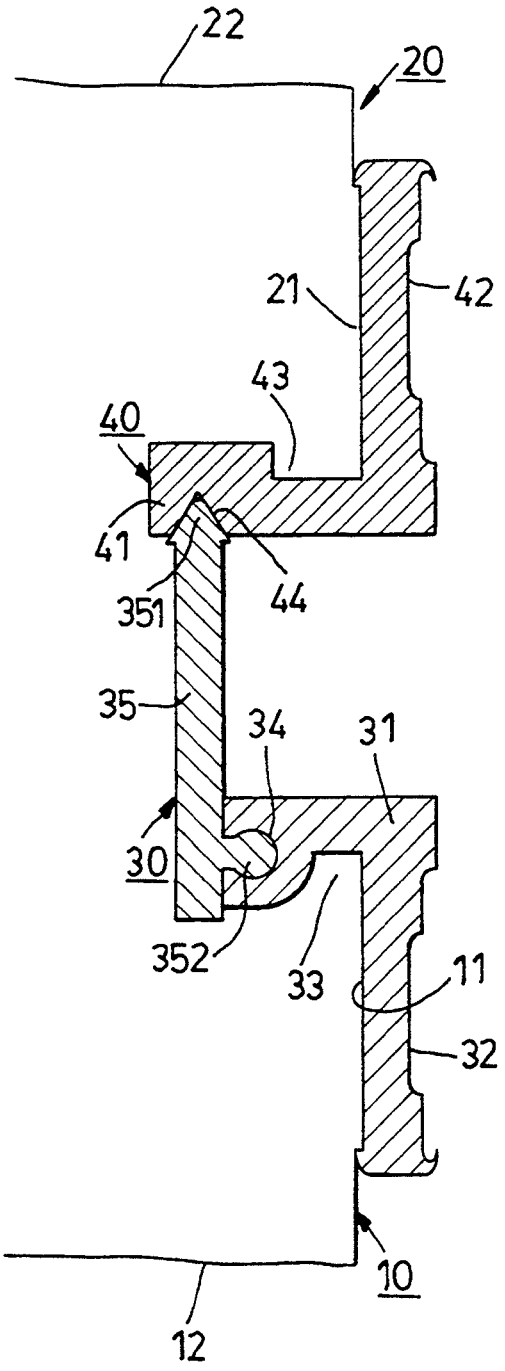
FIG.1 PRIOR ART
FIG. 1 shows a partially enlarged view of a conventional trunk case.
Figure 2:
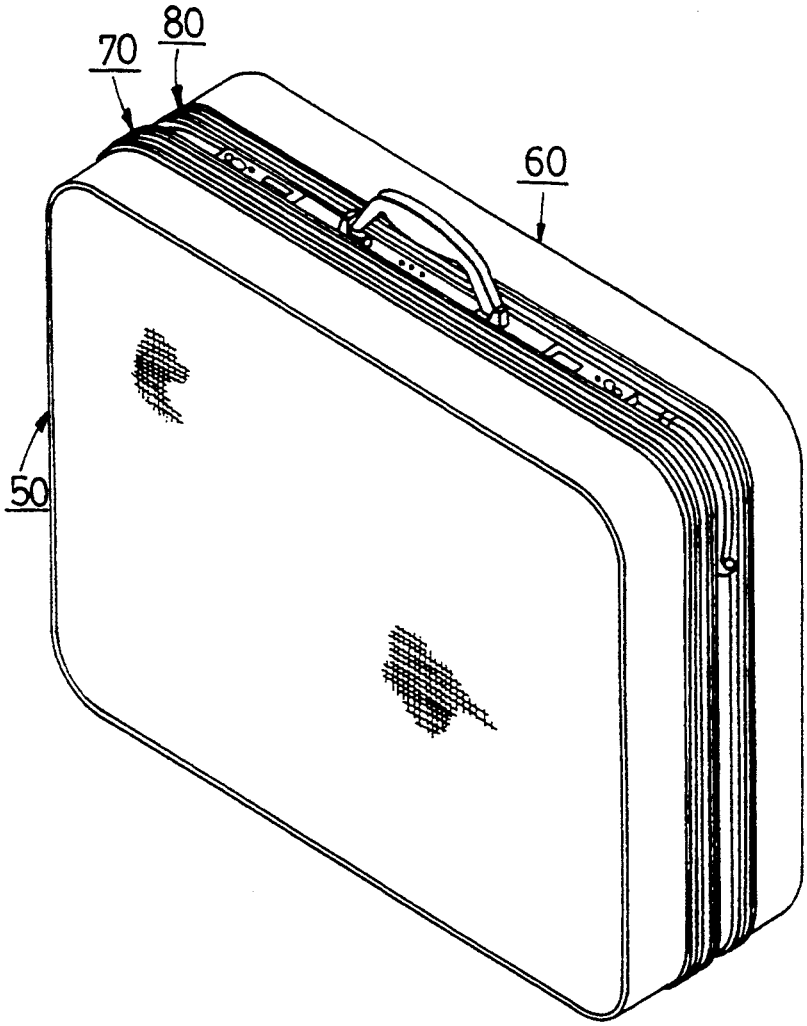
FIG. 2 illustrates a perspective, schematic view of a trunk case which is constructed according to the present invention.
Figure 3:
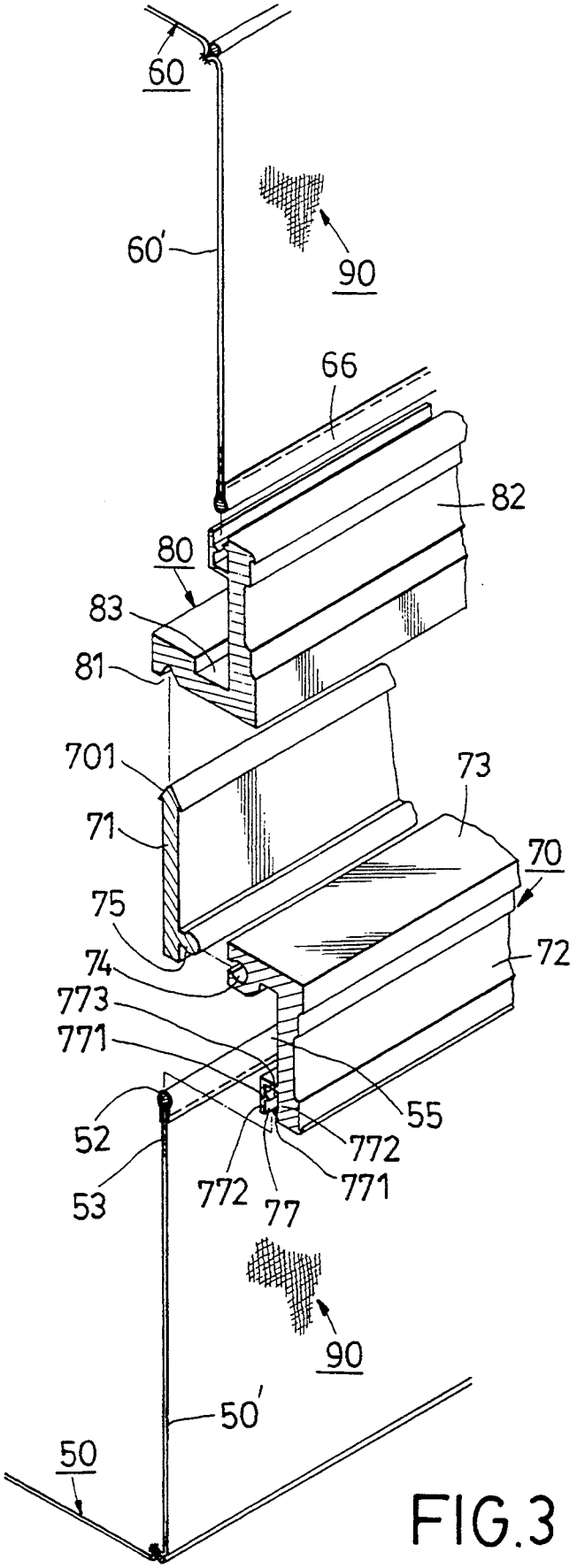
FIG. 3 is a partially exploded view of a trunk case of the present invention.

Before the present invention is described in greater detail, it should be noted that like elements are indicated by the same reference numerals throughout the disclosure.

Referring to FIGS. 2 to 7, the trunk case of the present invention is shown to be substantially is similar to the conventional trunk case and therefore, only the characteristic parts thereof with will be detailed in the following paragraphs.

Each of the casings 50, 60 is made of a water-proof cloth sheet 90 and has a square bottom (not shown) and a surrounding wall 50', 60' provided around the periphery of the bottom to define the respective casing. The periphery of the surrounding wall 50', 60' is wrapped around a rigid iron bar 52 so as to form a folded portion 55, 66 with two marginal layers 51. An insert layer 53, such as a polyethylene plate, is inserted between the marginal layers 51 of the folded portion 55, 66, thereby providing the folded portion 55, 66 with a relative stiffness. A relatively hard cover sheet 56, such as a thin metal plate, is wrapped over the folded portion 55, 66 and is fastened thereon to maintain the rigid iron bar 52 at the proper position, thereby defining a peripheral enlarged portion.

Figure 5:
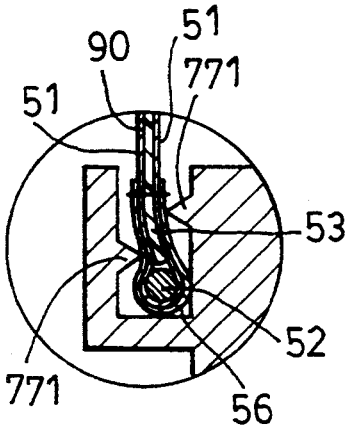
FIG. 5 is an enlarged view of the circles "P" and "Q" of the trunk case shown in FIG. 4.

Two L-shaped frame members 70, 80 are mounted to the enlarged portions of the surrounding walls 50', 60' of the first and second casings 50, 60. Each of the L-shaped frame members 70, 80 is made of aluminum and has an engaging portion 773 which is formed with a groove 77 that is defined by two opposed plates 772 and a pair of ribs 771 that project respectively from inner surfaces of the opposed plates 772 in a staggered manner. The pair of ribs 771 cooperate to define a gap therebetween which is wide enough to permit the enlarged portion of the surrounding wall 50', 60' to extend into the bottom of the groove 77, as shown in FIG. 5.

Figure 6:
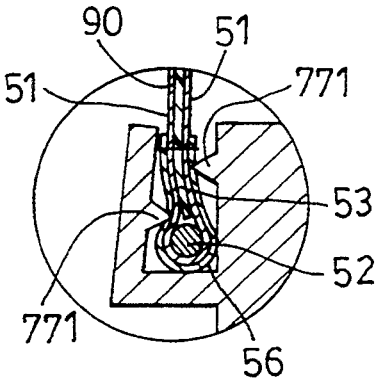
FIG. 6 illustrates the enlarged peripheral edge of one of the casings of the trunk case when engaged within a frame member.

The pair of ribs 771 are preferably tapered so that after inserting the enlarged portion of the surrounding wall 50', 60' into the bottom of the groove 77 of the respective L-shaped frame member 70, 80, the engaging portion of the L-shaped frame member 70, 80 can be depressed from an exterior thereof. Under this condition, the gap defined by the ribs 771 of the L-shaped frame member 70, 80 narrows so as to engage securely the surrounding wall 50', 60' adjacent to the enlarged portion, as shown in FIG. 6. Thus, the L-shaped frame member 70, 80 will not disengage from the respective casing 50, 60 no matter how heavy the load which is carried by the trunk case.

Figure 4:
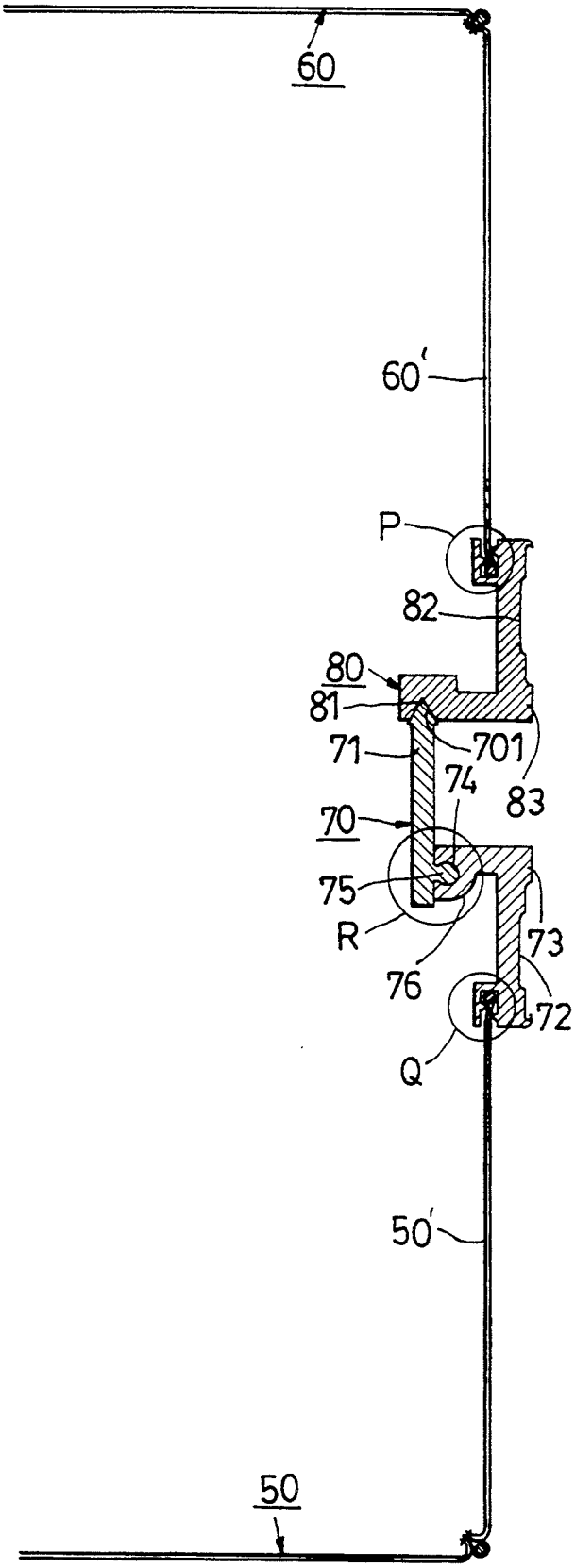
FIG. 4 is a partial sectional view of the trunk case shown in FIG. 3 when in a closed position.

FIG. 4 shows a cross sectional view of the frame member of the trunk case of the present invention. The L-shaped frame member 80 further includes a horizontal portion 83 which is provided with an elongated inverted V-shaped groove 81. The L-shaped frame member 70 is also provided with a substantially curved groove 74. A vertical connecting plate 71 has a tapered end 701 and an elongated round protrusion 75 formed along and adjacent to the lowermost portion of the connecting plate 71.

Figure 7:
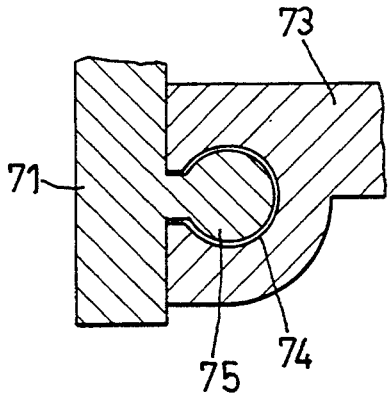
FIG. 7 is an enlarged view of the circle "R" of the trunk case shown in FIG. 4.

Referring to FIG. 7, the round protrusion 75 of the connecting plate 71 is received loosely in the curved groove 74 of the L-shaped frame member 70 to facilitate bending of the connecting plate 71 and the frame member 70 into a desired shaped when forming a frame member to complement with the surrounding wall. Since the surrounding wall 50' of the casing 50 is provided with the connecting frame that is made in the above-mentioned manner, the tapered end 701 of the vertical connecting plate 71 fits in the inverted V-shaped groove 81 of the L-shaped frame member 80 when the trunk case is at a closed position.

From the above explanation, it can be seen that the frame member cannot easily disengage from the respective casing of the trunk case of the present invention.

While a preferred embodiment has been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A trunk case including a first and second casing which are hinged together at one side thereof, each of said first and second casings having a substantially flat bottom and a surrounding wall formed around said flat bottom so as to define the respective casing and a frame member mounted along a peripheral edge of said surrounding wall; wherein said surrounding wall has a folded portion formed along the peripheral edge thereof, said folded portion having an insert layer sandwiched fixedly therein and a rigid bar embedded in said folded portion along said peripheral edge, thereby forming a peripheral enlarged portion; and a hard cover sheet is wrapped around said peripheral enlarged portion; and wherein said frame member includes an engaging portion which is formed with a groove that is defined by two opposed plates and a pair of ribs that project respectively from inner surfaces of said opposed plates in a staggered manner, said enlarged portion extending into a bottom of said groove, and said surrounding wall being clamped by said ribs near said enlarged portion.

2. The trunk case as defined in claim 1, wherein each of said casings is made from a sheet of cloth, said insert layer being made of a plastic plate.

3. The trunk case as defined in claim 1, wherein each of said ribs is triangular in cross section.

4. The trunk case as defined in claim 1, wherein said frame member is made of aluminun.

* * * * *